US011555335B2

(12) United States Patent
Perkins

(10) Patent No.: US 11,555,335 B2
(45) Date of Patent: Jan. 17, 2023

(54) VEHICLE LATCH WITH DOUBLE PULL RELEASE

(71) Applicant: INTEVA PRODUCTS, LLC, Troy, MI (US)

(72) Inventor: Donald Michael Perkins, Sterling Heights, MI (US)

(73) Assignee: INTEVA PRODUCTS, LLC, Troy, MI (US)

( * ) Notice: Subject to any disclaimer, the term of this patent is extended or adjusted under 35 U.S.C. 154(b) by 758 days.

(21) Appl. No.: 16/516,353

(22) Filed: Jul. 19, 2019

(65) Prior Publication Data

US 2020/0024871 A1 Jan. 23, 2020

Related U.S. Application Data

(60) Provisional application No. 62/701,265, filed on Jul. 20, 2018.

(51) Int. Cl.

| | |
|---|---|
| ***E05B 79/22*** | (2014.01) |
| ***E05B 79/20*** | (2014.01) |
| ***E05B 77/30*** | (2014.01) |
| *E05B 81/90* | (2014.01) |

(52) U.S. Cl.

CPC ..... *E05B 77/30* (2013.01); *E05B 79/20* (2013.01); *E05B 81/90* (2013.01); *E05Y 2900/531* (2013.01); *Y10T 292/1082* (2015.04)

(58) Field of Classification Search

CPC ..... E05B 77/30; E05B 79/20; E05B 81/90; Y10T 292/1082

See application file for complete search history.

(56) References Cited

U.S. PATENT DOCUMENTS

| | | | | |
|---|---|---|---|---|
| 5,832,757 | A | 11/1998 | Chikata et al. | |
| 8,727,398 | B2 * | 5/2014 | Brose | E05B 77/30 292/84 |
| 8,967,678 | B2 * | 3/2015 | Rosales | E05B 77/26 292/216 |
| 9,593,512 | B2 * | 3/2017 | Rosales | E05C 3/12 |
| 9,845,622 | B2 * | 12/2017 | Brose | E05B 77/06 |

(Continued)

FOREIGN PATENT DOCUMENTS

| | | |
|---|---|---|
| CN | 105317298 A | 2/2016 |
| CN | 107109870 A | 8/2017 |

(Continued)

OTHER PUBLICATIONS

Chinese Office Action for Application No. 201910662358.3; dated Aug. 3, 2020.

*Primary Examiner* — Carlos Lugo

(74) *Attorney, Agent, or Firm* — Cantor Colburn LLP

(57) ABSTRACT

A double pull mechanism of a vehicle latch including: a release link; a cable lever pivotally mounted to a portion of the vehicle latch; a manual release pawl pivotally mounted to the cable lever; a lock spring mounted to the release link; a cable secured to the cable lever, wherein pivotal movement of the cable lever via actuation of the cable a first time causes movement of the lock spring such that a protrusion of the manual release pawl is received in an opening of the release link and wherein actuation of the cable a second time causes movement of the release link via engagement of the protrusion in the opening.

5 Claims, 5 Drawing Sheets

(56) References Cited

U.S. PATENT DOCUMENTS

| | | | | |
|---|---|---|---|---|
| 10,273,726 | B2 | 4/2019 | Park | |
| 10,458,156 | B2 * | 10/2019 | Dow | E05B 43/00 |
| 10,590,681 | B2 | 3/2020 | Jeong | |
| 11,008,785 | B2 * | 5/2021 | Perez | E05B 79/22 |
| 2005/0206174 | A1 * | 9/2005 | Fisher | E05B 83/36<br>292/226 |
| 2017/0350172 | A1 | 12/2017 | Tamura et al. | |

FOREIGN PATENT DOCUMENTS

| | | | | | |
|---|---|---|---|---|---|
| CN | 107109872 | A | | 8/2017 | |
| CN | 107956339 | B | * | 1/2021 | B60J 5/06 |
| DE | 19737179 | B4 | | 4/2007 | |
| DE | 102006003023 | A1 | * | 7/2007 | B60R 25/24 |
| DE | 202008012536 | U1 | * | 3/2010 | E05B 77/26 |
| DE | 202008016705 | U1 | * | 6/2010 | E05B 15/0053 |
| FR | 3080400 | A1 | * | 10/2019 | E05B 81/76 |
| JP | 2006176969 | A | | 7/2006 | |
| JP | 2015086523 | A | * | 5/2015 | E05B 79/20 |
| WO | WO-2013170363 | A1 | * | 11/2013 | E05B 77/26 |

* cited by examiner

VEHICLE LATCH WITH DOUBLE PULL RELEASE

CROSS REFERENCE TO RELATED APPLICATIONS

This application claims the benefit of U.S. Provisional Patent application No. 62/701,265 filed on Jul. 20, 2018, the entire contents of which are incorporated herein by reference thereto.

BACKGROUND

Exemplary embodiments of the present disclosure pertain to the art of vehicle latches and in particular, latches that employ a double pull release.

Electric release latches are not configured with a mechanical lock system that decouples the release mechanism from the latch retention system. As such, a manual emergency release mechanism is provided to release the latch retention system. An application of such an emergency release mechanism is usually coupled directly to the retention system resulting in a "single pull" to release the latch manually.

However and depending on the location of the electric release latch there is a need for alternative manual release systems.

BRIEF DESCRIPTION

Disclosed herein is a double pull mechanism of a vehicle latch is disclosed herein. The double pull mechanism including: a release link; a cable lever pivotally mounted to a portion of the vehicle latch; a manual release pawl pivotally mounted to the cable lever; a lock spring mounted to the release link; a cable secured to the cable lever, wherein pivotal movement of the cable lever via actuation of the cable a first time causes movement of the lock spring such that a protrusion of the manual release pawl is received in an opening of the release link and wherein actuation of the cable a second time causes movement of the release link via engagement of the protrusion in the opening.

In addition to one or more of the features described above, or as an alternative to any of the foregoing embodiments, the release link causes a portion of the lock spring to contact the protrusion of the manual release pawl in order to move the protrusion from the opening of the release link.

In addition to one or more of the features described above, or as an alternative to any of the foregoing embodiments, movement of the cable lever causes a portion of manual release pawl to contact a portion of the lock spring to move until a portion of the lock spring to engage a spring retaining feature of the release link.

In addition to one or more of the features described above, or as an alternative to any of the foregoing embodiments, movement of the release link causes a portion of the lock spring to contact a reset feature so that the lock spring no longer engages the spring retaining feature of the release link.

In addition to one or more of the features described above, or as an alternative to any of the foregoing embodiments, the cable is secured to an inner vehicle door handle.

BRIEF DESCRIPTION OF THE DRAWINGS

The following descriptions should not be considered limiting in any way. With reference to the accompanying drawings, like elements are numbered alike.

DETAILED DESCRIPTION

A detailed description of one or more embodiments of the disclosed apparatus and method are presented herein by way of exemplification and not limitation with reference to the Figures.

Figure 1:
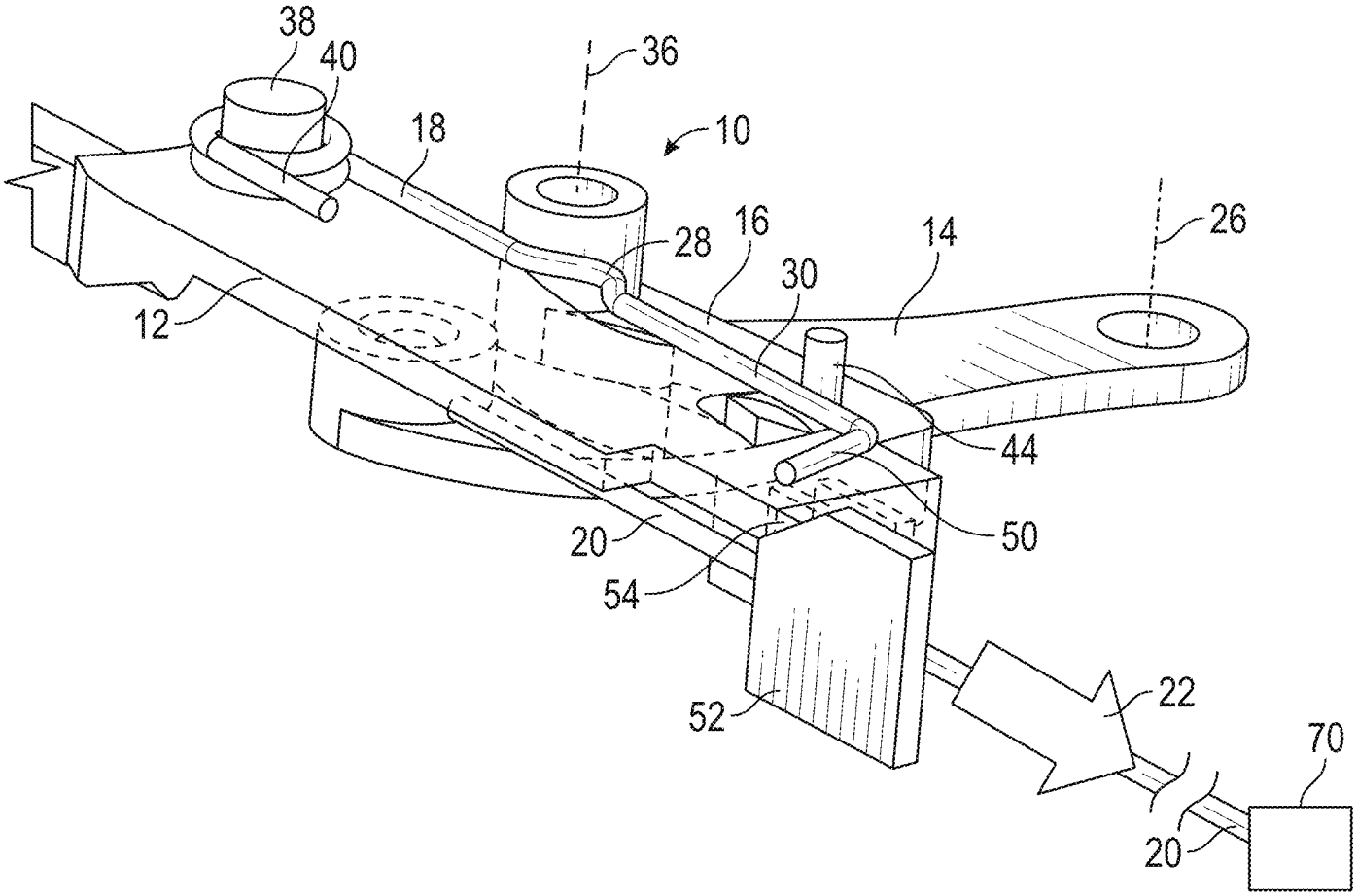
FIG. 1 is a perspective view of a double pull release mechanism completed for use with a vehicle latch.
Figure 1B:
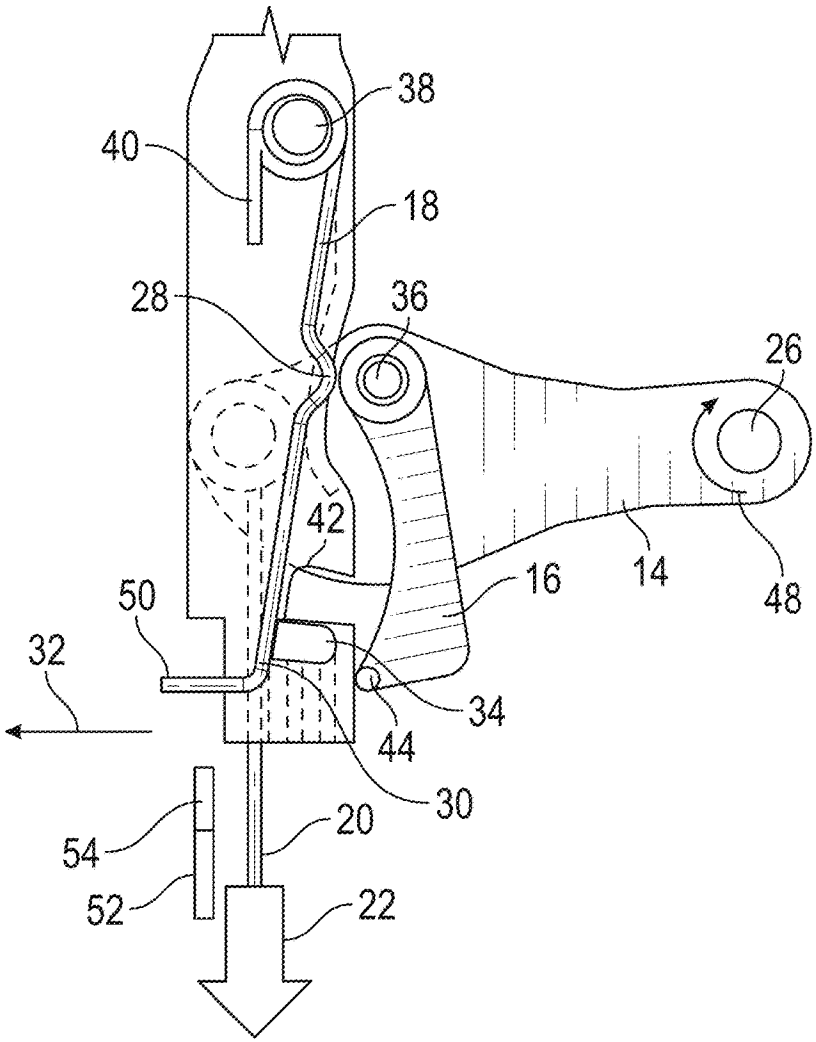
FIG. 1B is a view of the double pull release mechanism of FIG. 1 after a first pull.

FIG. 1 illustrates a perspective view of a double pull release mechanism 10. The double pull release mechanism 10 includes a release link 12, a cable lever 14, a manual release pawl 16 and a lock spring 18. A cable 20 is secured to the cable lever 14.

As mentioned above the double pull release mechanism 10 is contemplated for use with an electric release latch (not shown) such that the double pull release mechanism 10 can be used a manual release for the electric release latch.

Figure 1A:
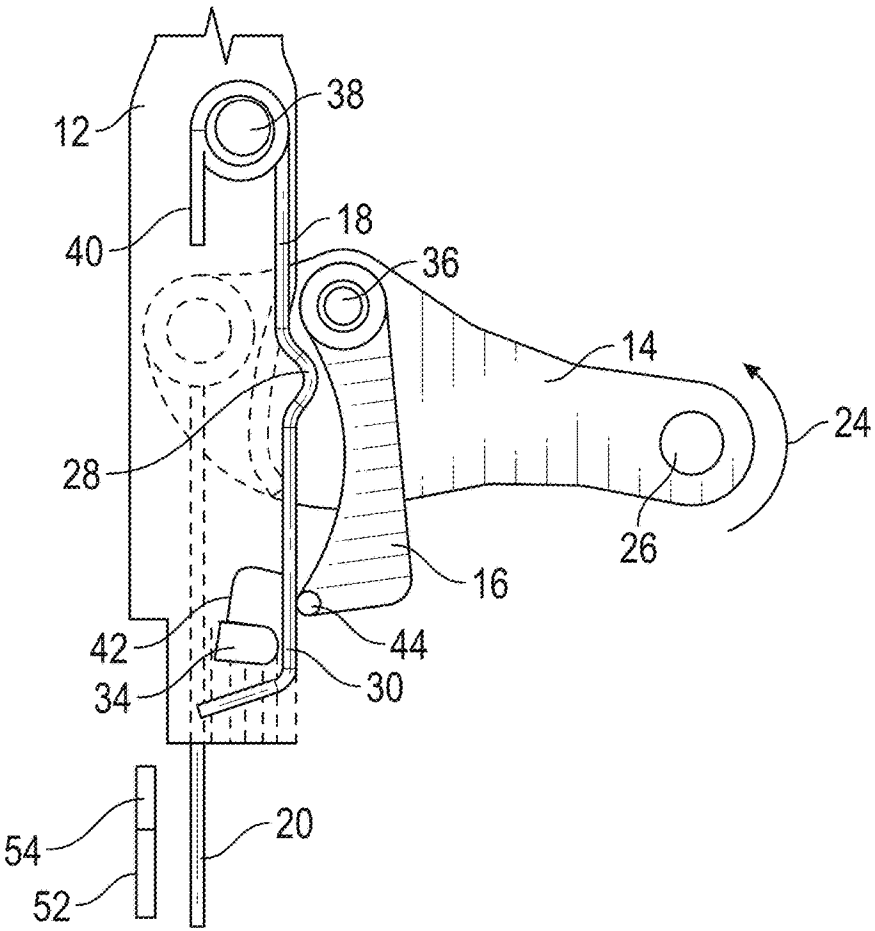
FIG. 1A is a view of the double pull release mechanism of FIG. 1 in a neutral position prior to a first pull.
Figure 2B:
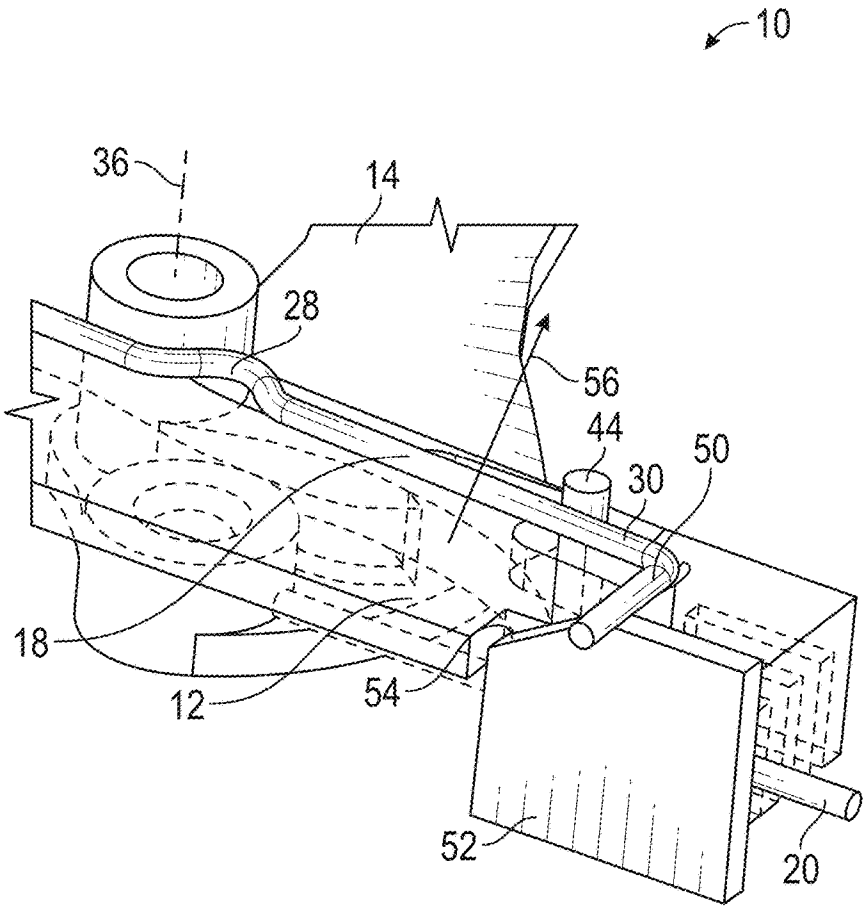
FIGS. 2B and 2C are perspective views of the double pull release mechanism illustrating release of a lock spring of the double pull release mechanism.
Figure 2A:
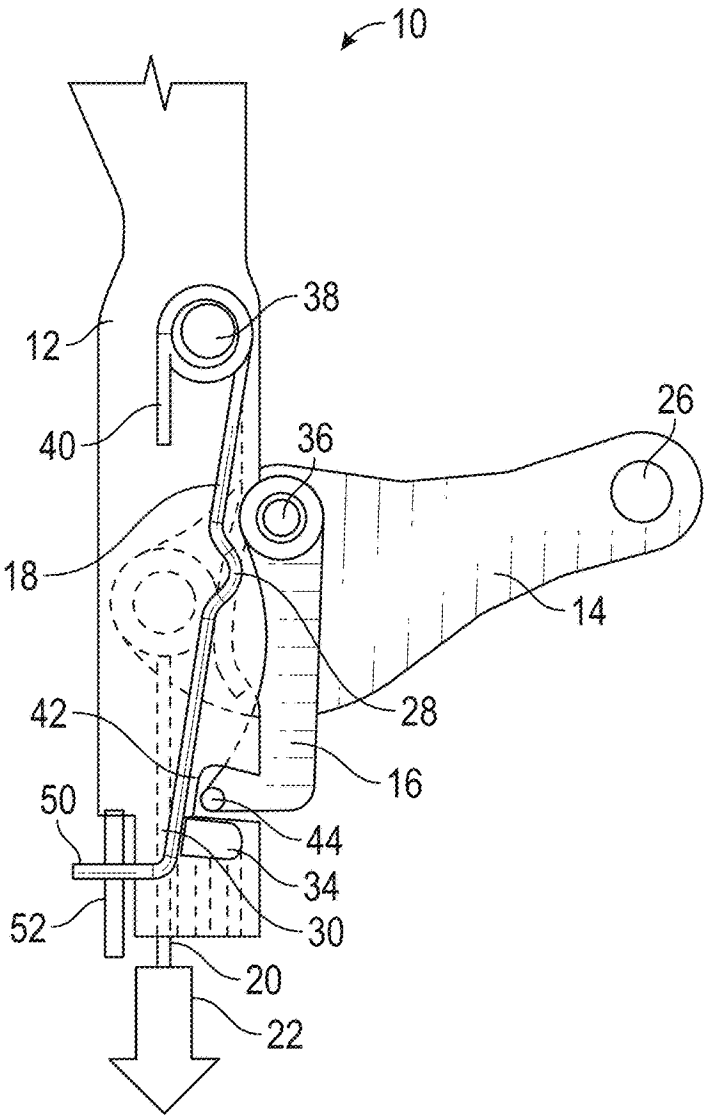
FIG. 2A is a view of the double pull release mechanism of FIG. 1 after a second pull which occurs after the first pull.
Figure 2C:
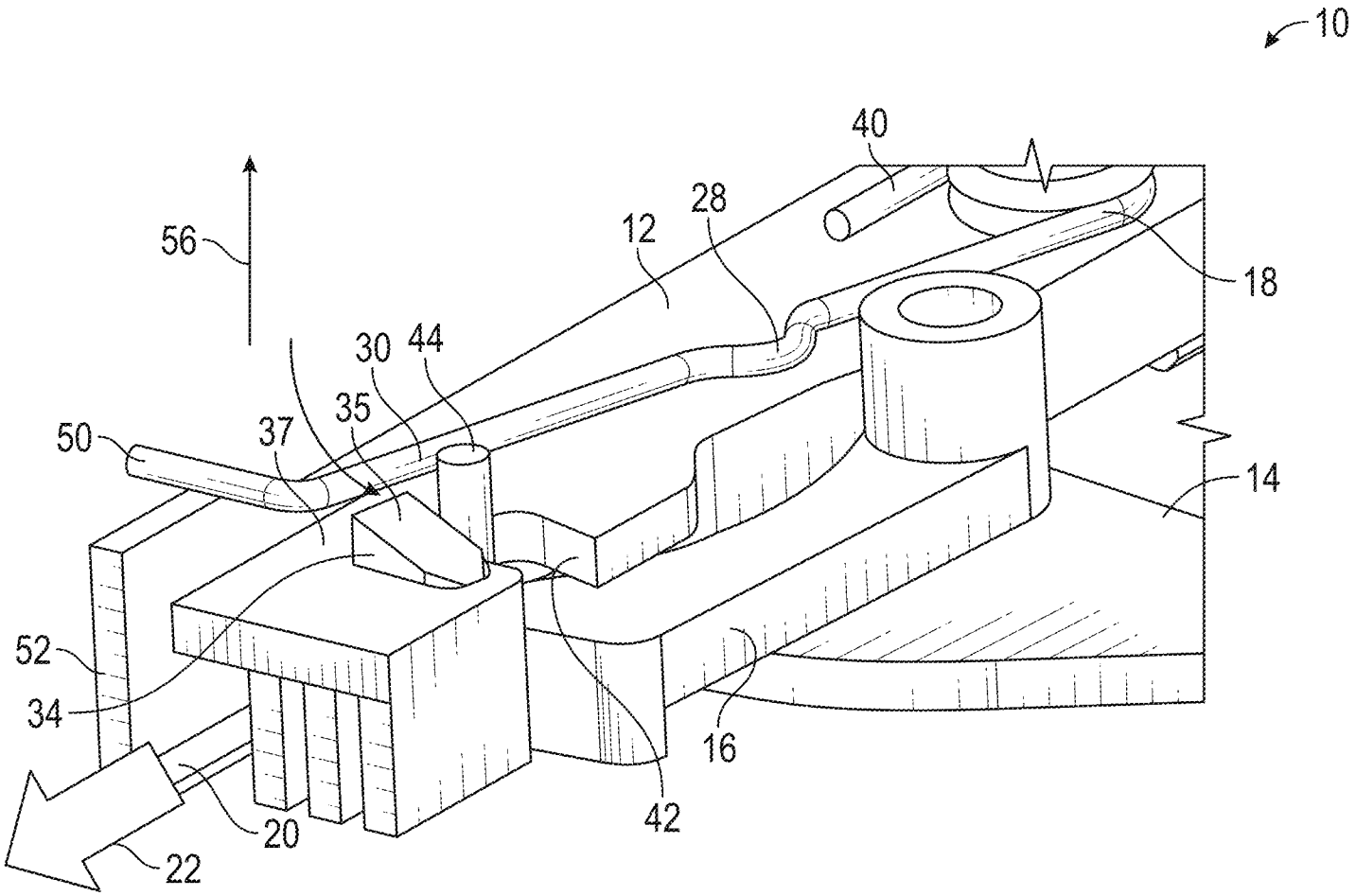

Referring now to FIGS. 1-2C, operation of the double pull release mechanism 10 will be described in accordance with one non-limiting embodiment of the present disclosure. When the double pull release mechanism 10 is in the neutral position (FIG. 1A) and as the cable 20 is pulled in the direction of arrow 22, the cable lever 14 will be rotated or pivoted in the direction of arrow 24. It being understood that the cable lever 14 is pivotally mounted to a portion of a vehicle latch (not shown) for movement about an axis 26. During this movement, a portion of the manual release pawl 16 will contact a portion or in one embodiment a protrusion 28 of the lock spring 18 such that movement of the cable lever 14 in the direction of arrow 24 about axis 26 will cause a portion 30 of the lock spring 18 to move in the direction of arrow 32 and be engaged by a spring retaining feature 34 of the release link 12. In one embodiment and as illustrated in at least FIG. 2C, the spring retaining feature 34 has an angled surface 35 and an edge 37 that engages the portion 30 of the lock spring 18.

It being understood that the manual release pawl 16 is pivotally mounted to the cable lever 14 for movement about an axis 36 and the lock spring 18 is mounted to a protrusion 38 of the release link 12 so that the portion 30 or other portions of the lock spring 18 can be moved in the direction of arrow 32. For example, an end 40 of the lock spring may engage a feature of the release link 12 in order to provide a biasing force in a direction opposite to arrow 32 when the portion 30 of the lock spring is moved in the direction of arrow 32.

Once the portion 30 of the lock spring 18 is engaged by spring retaining feature 34, an opening, channel or cavity 42 will be able to receive a protrusion 44 of the release pawl 14 when the release link 12 moves back into the neutral position. This is due to the release pawl 16 being spring biased about axis 36 in the direction of arrow 46 and the cable lever 14 being spring biased in the direction of arrow 48 about axis 26 as well as the portion 30 of the lock spring 18 no longer blocking opening 42. As such and when the cable pull force in the direction of arrow 22 ceases the cable lever 14 pivots or rotates in the direction of arrow 45 and since the release pawl 16 is spring biased in the direction of arrow 46 protrusion 44 will be received in channel 42 when the cable lever moves back to the neutral position. See FIG. 1D.

Figure 1D:
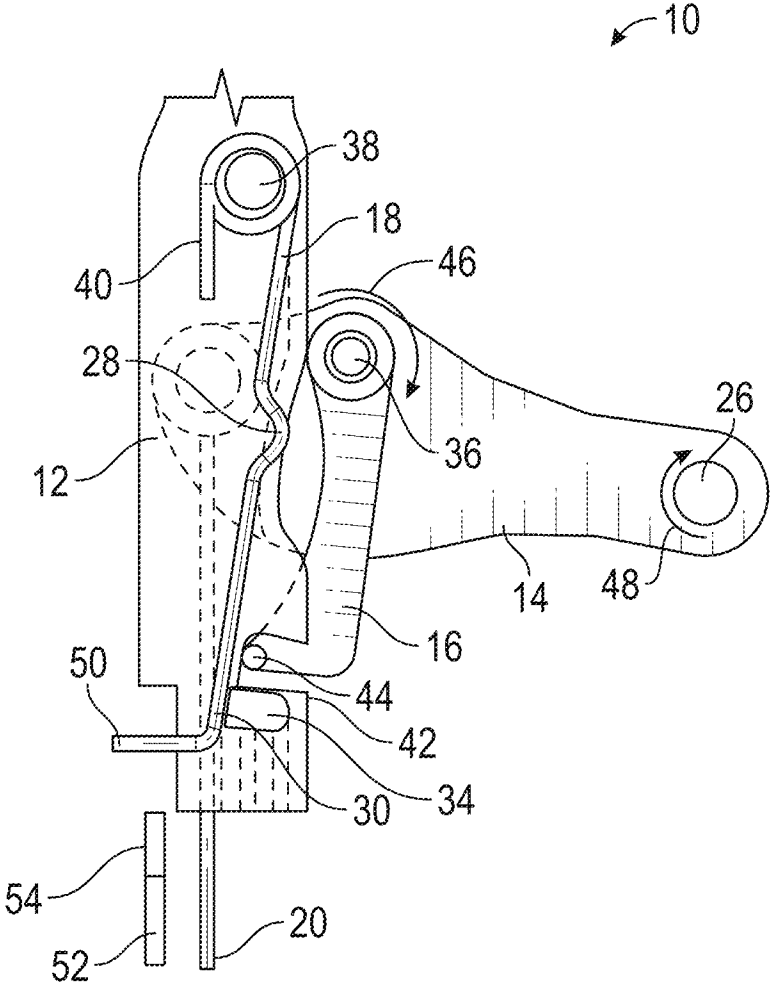
FIG. 1D is a view of the double pull release mechanism of FIG. 1 after it has returned to a neutral position after the first pull.
Figure 1C:
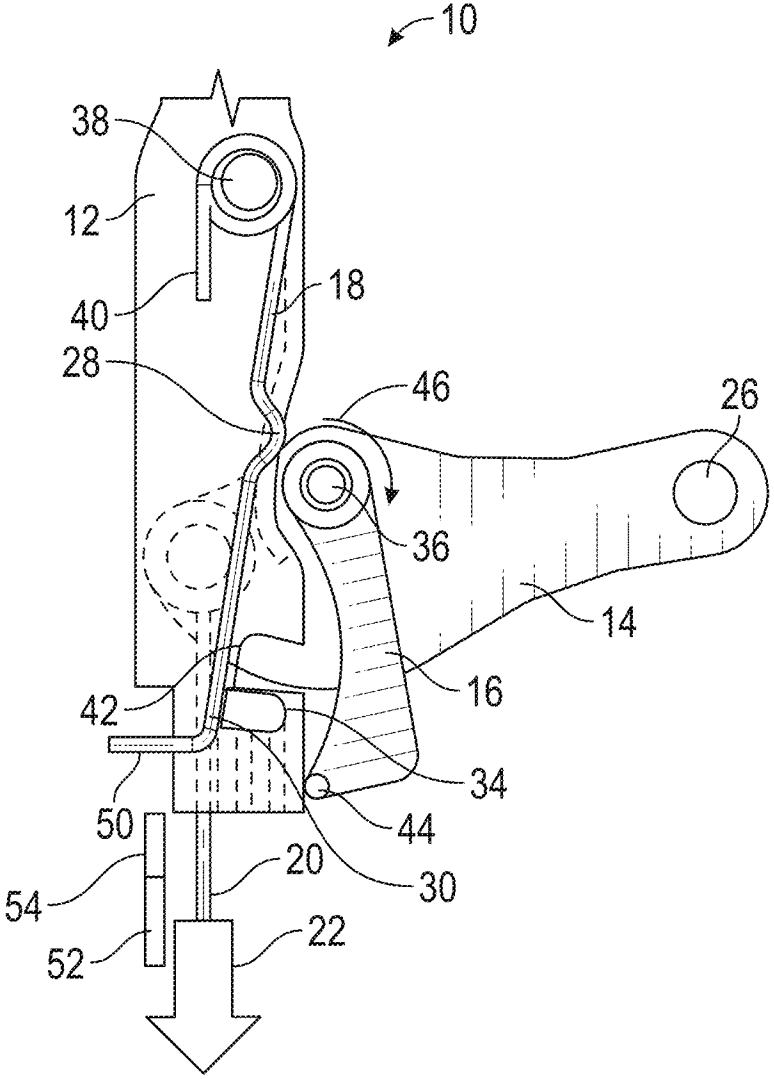
FIG. 1C is a view of the double pull release mechanism of FIG. 1 after the first pull and in a full travel position.

Thereafter and once the cable 20 is pulled a second time from the position illustrated in FIG. 1D, the release link 12 will also move in the direction of arrow 22 via engagement of protrusion 44 in channel 42. This movement is illustrated in at least FIG. 2A. The release link 12 is operably coupled to a portion of the latch that causes it to be released or any other desired movement of a component of the latch that causes a desired effect. Accordingly, and through the double pull of the cable 20, the release link 12 is moved via engagement of the release pawl 16 with the release link 12, which occurs after the first pull.

As the release link 12 moves in the direction of arrow 22 another portion 50 of the lock spring 18 will engage a reset feature 52, which has an angled or chamfered surface 54 that causes the another portion 50 of the lock spring 18 to move in the direction of arrow 56 so that portion 30 of the lock spring 18 no longer engages the spring retaining feature 34 and the lock spring 18 can move back into the position illustrated in at least FIG. 1A. During this movement (e.g., due to the spring bias of the lock spring 18) the lock spring 18 will contact the protrusion 44 of the release pawl 16 and pivot it about axis 36 so that the protrusion 44 of the release pawl 16 no longer engages the opening, channel or cavity 42. As such, the release link 12 and double pull mechanism 10 can return to the neutral position illustrated in FIG. 1A. Thereafter, the operation of the double pull release mechanism 10 can be operated again.

In one embodiment, the cable 20 of the double pull release mechanism 10 may be secured to an inner vehicle door handle 70 of a vehicle. In one embodiment, the double pull release mechanism 10 is operably secured to a vehicle latch, which in one non-limiting embodiment, the vehicle latch is electronic latch that is located in a rear door of a vehicle.

The term "about" is intended to include the degree of error associated with measurement of the particular quantity based upon the equipment available at the time of filing the application.

The terminology used herein is for the purpose of describing particular embodiments only and is not intended to be limiting of the present disclosure. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, element components, and/or groups thereof.

While the present disclosure has been described with reference to an exemplary embodiment or embodiments, it will be understood by those skilled in the art that various changes may be made and equivalents may be substituted for elements thereof without departing from the scope of the present disclosure. In addition, many modifications may be made to adapt a particular situation or material to the teachings of the present disclosure without departing from the essential scope thereof. Therefore, it is intended that the present disclosure not be limited to the particular embodiment disclosed as the best mode contemplated for carrying out this present disclosure, but that the present disclosure will include all embodiments falling within the scope of the claims.

What is claimed is:

1. A double pull mechanism of a vehicle latch, comprising:

a release link operatively coupled to a member of the vehicle latch;

a cable lever pivotally mounted to a portion of the vehicle latch;

a manual release pawl pivotally mounted to the cable lever;

a lock spring mounted to the release link;

a cable secured to the cable lever;

an actuator configured to pivotally operate the cable lever via the cable;

wherein, starting from a neutral position of the cable lever, pivotal movement of the cable lever via actuation of the cable a first time causes movement of the manual release pawl such that the manual release pawl causes movement of the lock spring exposing an opening on the release link;

wherein, release of the cable after it has been actuated the first time returns the cable lever to the neutral position such that a protrusion of the manual release pawl is received in the opening of the release link and wherein, starting from the neutral position of the cable lever, actuation of the cable a second time causes movement of the release link via engagement of the protrusion in the opening thereby moving the member of the vehicle latch.

2. The double pull mechanism as in claim 1, wherein movement of the release link causes a portion of the lock spring to contact the protrusion of the manual release pawl in order to move the protrusion from the opening of the release link.

3. The double pull mechanism as in claim 1, wherein movement of the cable lever causes a portion of manual release pawl to contact a portion of the lock spring to move until a portion of the lock spring to engage a spring retaining feature of the release link.

4. The double pull mechanism as in claim 3, wherein movement of the release link causes a portion of the lock spring to contact a reset feature so that the lock spring no longer engages the spring retaining feature of the release link.

5. The double pull mechanism as in claim 1, wherein the actuator is an inner vehicle door handle.

* * * * *